US008790073B2

(12) United States Patent
Mugglestone

(10) Patent No.: US 8,790,073 B2
(45) Date of Patent: Jul. 29, 2014

(54) GAS TURBINE ENGINE INCLUDING A STATOR VANE FOR DIRECTING HOT COMBUSTION GASES ONTO ROTOR BLADES

(75) Inventor: Jonathan Mugglestone, South Normanton (GB)

(73) Assignee: Siemens Aktiengesellschaft, Munich (DE)

( * ) Notice: Subject to any disclaimer, the term of this patent is extended or adjusted under 35 U.S.C. 154(b) by 323 days.

(21) Appl. No.: 13/145,580

(22) PCT Filed: Jan. 21, 2010

(86) PCT No.: PCT/EP2010/050662

§ 371 (c)(1),
(2), (4) Date: Nov. 2, 2011

(87) PCT Pub. No.: WO2010/084141

PCT Pub. Date: Jul. 29, 2010

(65) Prior Publication Data

US 2012/0039708 A1 Feb. 16, 2012

(30) Foreign Application Priority Data

Jan. 23, 2009 (EP) ..... 09151205

(51) Int. Cl.
*F01D 11/04* (2006.01)
*F01D 25/12* (2006.01)

(52) U.S. Cl.
USPC ..... 415/115; 415/116; 415/117; 415/173.7; 415/176; 415/178

(58) Field of Classification Search
USPC ..... 415/115, 116, 117, 173.7, 175–178
See application file for complete search history.

(56) References Cited

U.S. PATENT DOCUMENTS

| | | | | |
|---|---|---|---|---|
| 3,663,118 | A | 5/1972 | Johnson | |
| 4,309,145 | A * | 1/1982 | Viola | 415/173.7 |
| 4,353,679 | A * | 10/1982 | Hauser | 415/115 |
| 5,197,852 | A | 3/1993 | Elovic | |
| 5,197,853 | A | 3/1993 | Eckert | |

(Continued)

FOREIGN PATENT DOCUMENTS

| | | | |
|---|---|---|---|
| CN | 101315032 | A | 12/2008 |
| EP | 1582697 | A1 | 10/2005 |
| EP | 1870563 | A1 | 12/2007 |
| RU | 2179245 | C2 | 2/2002 |

*Primary Examiner* — Christopher Verdier

(57) ABSTRACT

A gas turbine engine including a stator vane directing hot combustion gases onto rotor blades is provided. The stator vane includes a platform disposed at the side of the vane radially inward/outward with respect to the axis of rotation of the engine, the platform having a trailing edge portion downstream with respect to the flow of gases past the stator vane. A support and cooling arrangement is included for directing a cooling fluid to an upstream end of a radially inwardly/outwardly facing side of the trailing edge portion of the platform, the arrangement also directing the cooling fluid to flow over the side in a generally axial direction to a downstream end of the side, the cooling fluid cooling the trailing edge portion as it flows over the side, wherein turbulators are included to increase heat transfer from the trailing edge portion as the cooling fluid flows over the side.

9 Claims, 5 Drawing Sheets

(56) References Cited

U.S. PATENT DOCUMENTS

| | | | | |
|---|---|---|---|---|
| 5,252,026 | A | 10/1993 | Shepherd | |
| 5,407,319 | A * | 4/1995 | Harrogate et al. | 415/115 |
| 6,830,427 | B2 * | 12/2004 | Lafarge et al. | 415/115 |
| 7,114,339 | B2 * | 10/2006 | Alvanos et al. | 415/115 |
| 2002/0159880 | A1 | 10/2002 | Morris et al. | |
| 2003/0167775 | A1 | 9/2003 | Soechting et al. | |
| 2004/0009059 | A1 * | 1/2004 | Soechting et al. | 415/115 |
| 2006/0127212 | A1 * | 6/2006 | Durocher et al. | 415/116 |

* cited by examiner

GAS TURBINE ENGINE INCLUDING A STATOR VANE FOR DIRECTING HOT COMBUSTION GASES ONTO ROTOR BLADES

CROSS REFERENCE TO RELATED APPLICATIONS

This application is the US National Stage of International Application No. PCT/EP2010/050662, filed Jan. 21, 2010 and claims the benefit thereof. The International Application claims the benefits of European Patent Office application No. 09151205.3 EP filed Jan. 23, 2009. All of the applications are incorporated by reference herein in their entirety.

FIELD OF INVENTION

This invention relates to a gas turbine engine.

BACKGROUND OF INVENTION

More particularly, the invention relates to a gas turbine engine including a stator vane for directing hot combustion gases onto rotor blades, the stator vane including a platform disposed at the side of the vane radially inward/outward with respect to the axis of rotation of the engine, the platform having a trailing edge portion downstream with respect to the flow of the hot combustion gases past the stator vane.

A part of one known such engine is shown in FIGS. 1 to 3. This known engine is disclosed in U.S. Pat. No. 5,252,026. FIG. 1 is a longitudinal section through the part. FIG. 2 is a view taken on the line II-II in FIG. 1. FIG. 3 is a view taken on the line in III-III in FIG. 2. The part comprises a stator vane 1 having radially inner and outer platforms 3 and 5, rotor blading 7, a rotor disk 9 to which the rotor blading 7 is attached, and a support and cooling arrangement 11.

The trailing edge 13 of radially inner platform 3 is cooled by air supplied to the edge via a passageway between adjacent parts 15, 17 of support and cooling arrangement 11. This supply is indicated by the arrows 19 in FIG. 1. Rotation of the rotor of the gas turbine engine causes the supplied air to travel circumferentially in the region 21 immediately radially inside the trailing edge 13. This circumferential travel is indicated by arrows 23 in FIGS. 2 and 3. As the air travels circumferentially it cools trailing edge 13. The air then passes via circumferentially extending gap 25 to join the hot combustion gases of the engine. Turbulators in the form of rectangular strips 27 are included on the radially inwardly facing side of edge 13 to increase heat transfer from the edge.

The described cooling in the known engine has certain disadvantages. The cooling air is supplied past high temperature rotating parts of the engine, is heated by both the temperature of these parts and friction with these parts, and therefore is less effective when it comes to cooling trailing edge 13. The shape of the region 21 combined with the nature of the flow through it tends to encourage areas within the region where the flow is relatively stagnant, reducing cooling. If the pressure differential between the region 21 and the path of the hot combustion gases of the engine is relatively high then the cooling air will leave region 21 via circumferentially extending gap 25 relatively rapidly without having spent much time travelling circumferentially in region 21 to cool trailing edge 13.

SUMMARY OF INVENTION

According to the present invention there is provided a gas turbine engine including a stator vane for directing hot combustion gases onto rotor blades, the stator vane including a platform disposed at the side of the vane radially inward/outward with respect to the axis of rotation of the engine, the platform having a trailing edge portion downstream with respect to the flow of the hot combustion gases past the stator vane, the engine also including a support and cooling arrangement for directing a cooling fluid to an upstream end of a radially inwardly/outwardly facing side of the trailing edge portion of the platform, the support and cooling arrangement also directing the cooling fluid to flow over the side in a generally axial direction to a downstream end of the side, the cooling fluid cooling the trailing edge portion as it flows over the side, wherein turbulators are included on the side to increase heat transfer from the trailing edge portion as the cooling fluid flows over the side. An inwardly facing side includes a number of discrete axially extending cooling channels. Turbulators are located at the inwardly facing side inside the cooling channels. The turbulators extend traverse (i.e. non-parrallel) to the axial direction of the axis of ratation of the engine.

In an engine according to the preceding paragraph, it is preferable that the platform is disposed at the side of the vane radially inward with respect to the axis of rotation of the engine, and the support and cooling arrangement directs the cooling fluid to the upstream end of a radially inwardly facing side of the trailing edge portion of the platform.

In an engine according to the preceding paragraph, it is preferable that the support and cooling arrangement includes a carrier ring, and a portion of the periphery of the carrier ring lies adjacent the radially inwardly facing side, the cooling fluid flowing over the side in the generally axial direction by travelling via a first interface between the side and the carrier ring.

In an engine according to the preceding paragraph, it is preferable that the platform includes a radially inwardly extending flange at the upstream end of the trailing edge portion, and the portion of the periphery of the carrier ring also lies adjacent a downstream facing side of the flange, the cooling fluid travelling to the upstream end of the radially inwardly facing side by travelling generally radially outwardly via a second interface between the downstream facing side of the flange and the carrier ring.

In an engine according to the preceding paragraph, it is preferable that a cavity for supplying cooling fluid is defined between the platform and the support and cooling arrangement, and the portion of the periphery of the carrier ring also lies adjacent a radially inwardly facing end of the flange, cooling fluid being supplied by the cavity to the second interface by leaving the cavity in a generally downstream direction via a third interface between the radially inwardly facing end of the flange and the carrier ring.

In an engine according to the preceding paragraph, it is preferable that the cavity also supplies cooling fluid to the interior of the stator vane.

In an engine according to any one of the preceding five paragraphs, it is preferable that there is a further flow of cooling fluid that cools the trailing edge portion, and this further flow travels past a rotor disk of the engine to which the rotor blades are attached.

In an engine according to any one of the preceding six paragraphs, it is preferable that the radially inwardly facing side incorporates a number of axially extending wall partitions that divide the side into a number of discrete axially extending cooling channels, the turbulators included on the side being located in the cooling channels.

In an engine according to the preceding paragraph, it is preferable that the turbulators extend generally across the cooling channels.

In an engine according to the preceding paragraph, it is preferable that the turbulators are chevron turbulators.

In an engine according to any one of the preceding three paragraphs, it is preferable that more cooling fluid is supplied to certain cooling channels than others.

BRIEF DESCRIPTION OF THE DRAWINGS

The invention will now be described, by way of example, with reference to the accompanying drawings, in which.

DETAILED DESCRIPTION OF INVENTION

Figure 4:
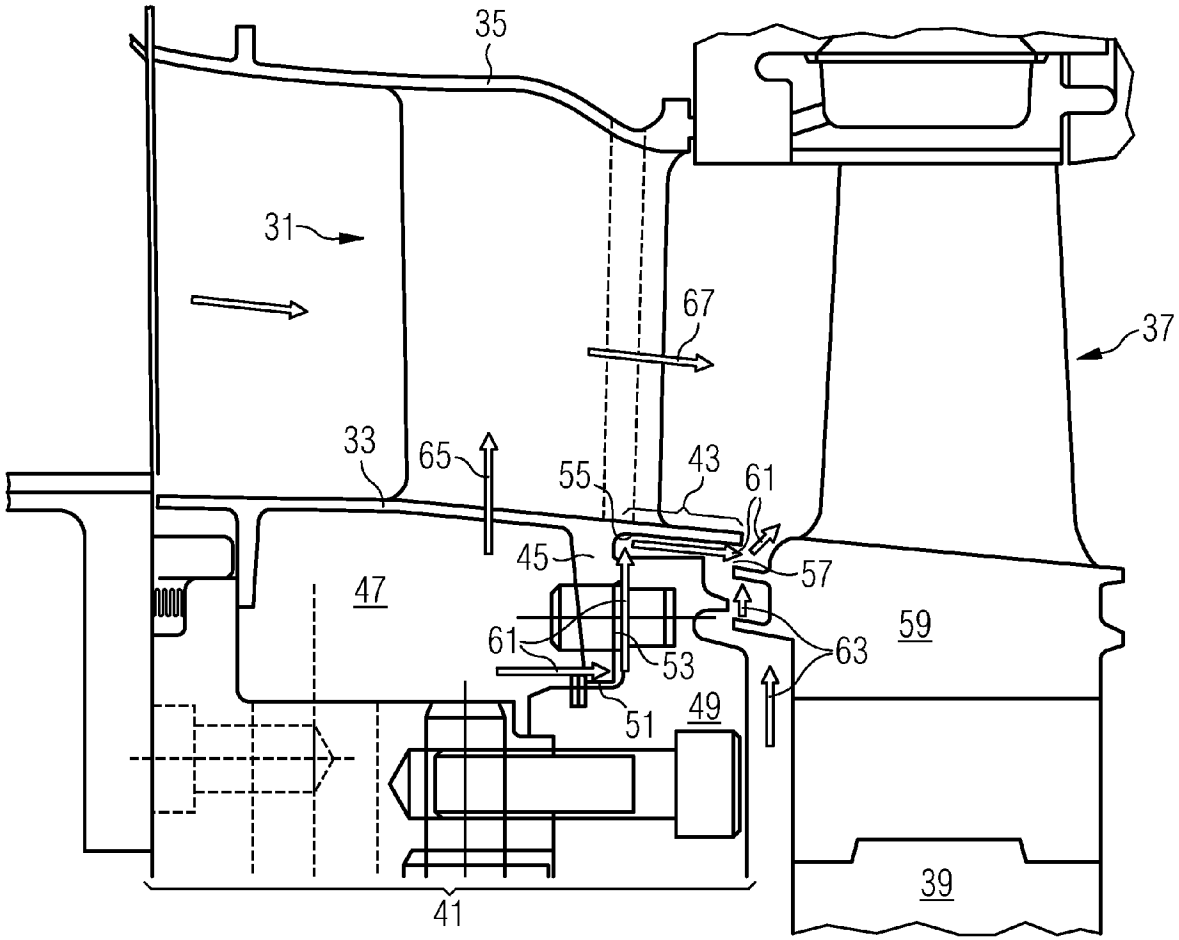
FIG. 4 is a longitudinal section through a part of a gas turbine engine according to the present invention.
Figure 5:
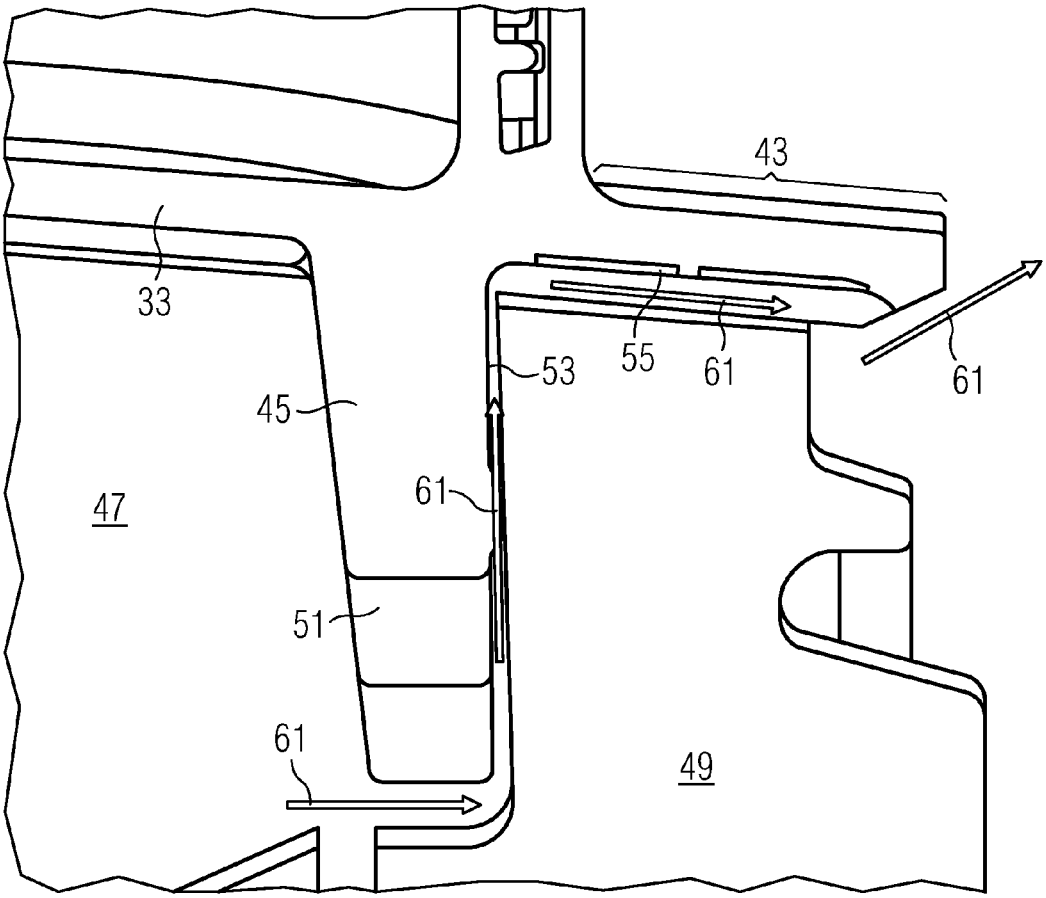
FIG. 5 illustrates in greater detail a cooling fluid flow path shown in FIGS. 4.

The part shown in FIG. 4 comprises a stator vane 31 having radially inner and outer platforms 33 and 35, rotor blading 37, a rotor disk 39 to which the rotor blading 37 is attached, and a support and cooling arrangement 41. The radially inner platform 33 has a trailing edge 43 and, at the upstream end of this edge 43, a flange 45 that extends radially inwardly. The support and cooling arrangement 41 defines between itself and radially inner platform 33 a cavity 47 from which a cooling fluid is supplied to cool stator vane 31. The arrangement 41 includes a carrier ring 49, a portion of the periphery of which lies adjacent (i) a radially inwardly facing end 51 of flange 45, (ii) a downstream facing side 53 of flange 45, and (iii) a radially inwardly facing side 55 of trailing edge 43. FIG. 5 shows in greater detail the interface between carrier ring 49 and flange 45/trailing edge 43 of radially inner platform 33. A circumferentially extending gap 57 is present between the downstream end of trailing edge 43 and a base part 59 of the rotor blading 37.

Cooling fluid travels as follows as indicated by arrows 61. It leaves cavity 47 in a generally downstream direction via the interface between carrier ring 49 and radially inwardly facing end 51 of flange 45. It then travels generally radially outwardly via the interface between carrier ring 49 and downstream facing side 53 of flange 45. At this point the cooling fluid reaches the upstream end of trailing edge 43. The cooling fluid then travels generally downstream via the interface between carrier ring 49 and radially inwardly facing side 55 of trailing edge 43, to reach the downstream end of edge 43. The cooling fluid cools trailing edge 43 as it flows over radially inwardly facing side 55. Finally, the cooling fluid passes through circumferential extending gap 57 to join the hot combustion gases of the gas turbine engine.

The supply of cooling fluid to cool trailing edge 43 is not via high temperature rotating parts of the engine, but from cavity 47. Thus, the cooling fluid is not heated by both the temperature of and friction with the rotating parts, and therefore cools more effectively. The interface between carrier ring 49 and radially inner platform 33 closely controls the flow of cooling fluid over radially inwardly facing side 55 of trailing edge 43, such that the flow is substantially uniformly spread over side 55, and as it travels from the upstream end to the downstream end of side 55 takes a path that is substantially parallel to side 55. Thus, areas of relatively stagnant flow over side 55 are substantially prevented, enhancing the cooling of trailing edge 43. The close control of the flow of cooling fluid by the interface between carrier ring 49 and radially inner platform 33 ensures that the flow will travel over side 55 regardless of the pressure differential between the interface and the path of the hot combustion gases of the gas turbine engine. Thus, the presence of a relatively high such pressure differential will not substantially affect the cooling of trailing edge 43.

Figure 1:
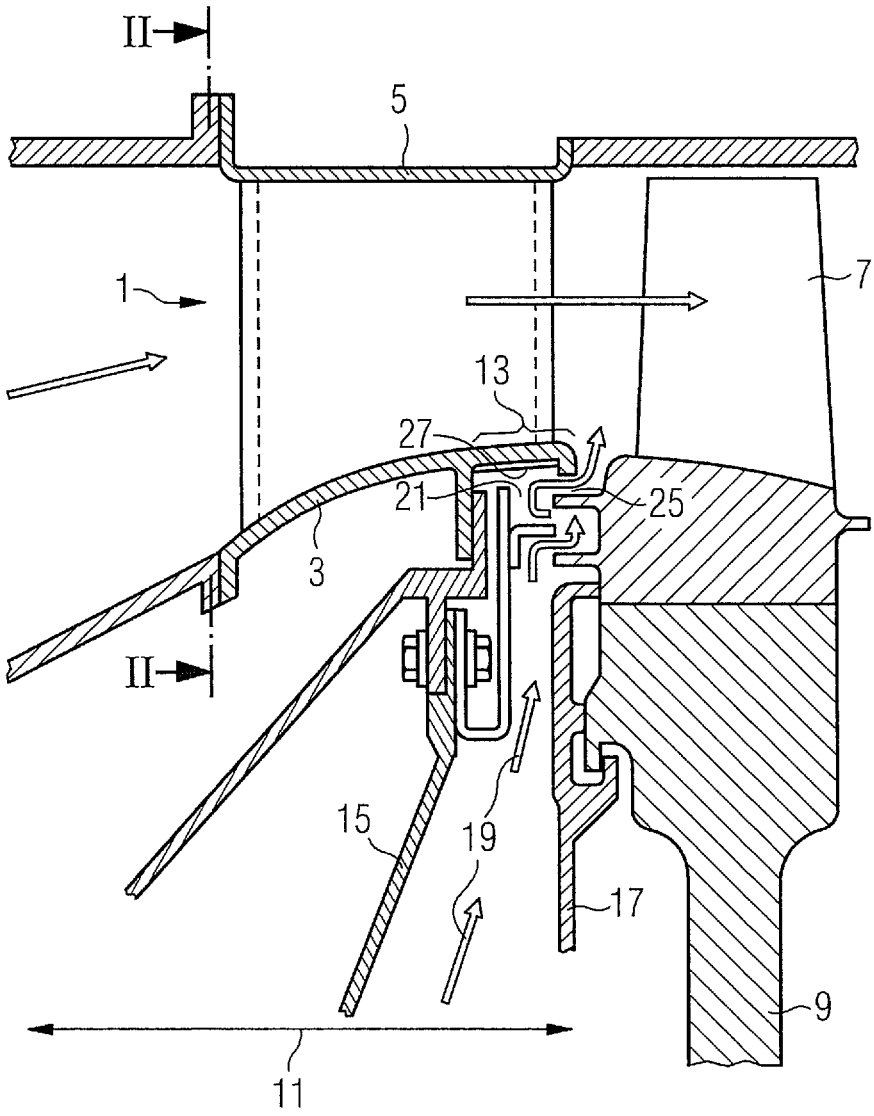
FIG 1 (Prior art)
FIG. 1, already referred to, is a longitudinal section through a part of a known gas turbine engine.
Figure 2:
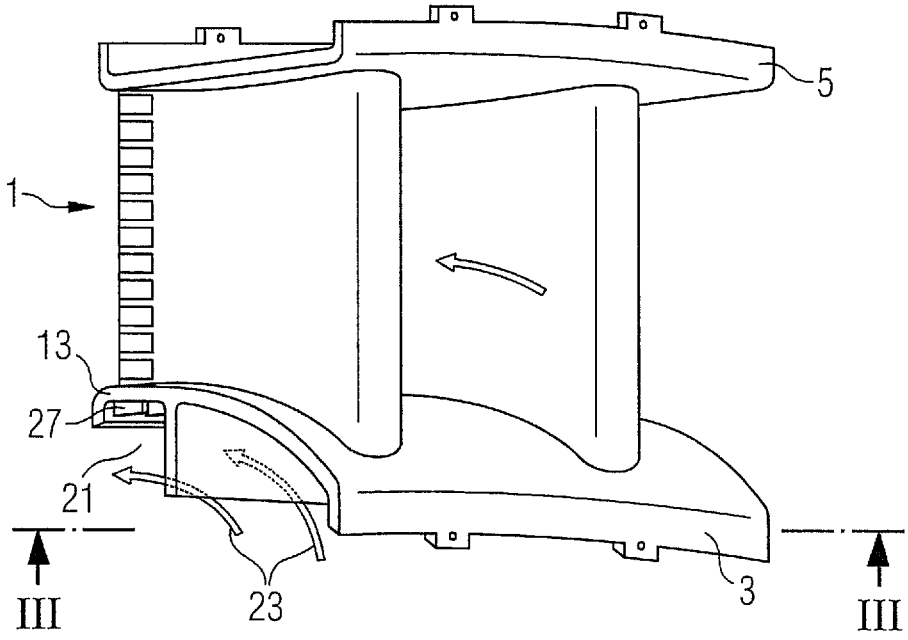
FIG 2 (Prior art)
FIG. 2, already referred to, is a view taken on the line II-II in FIG. 1.
Figure 3:
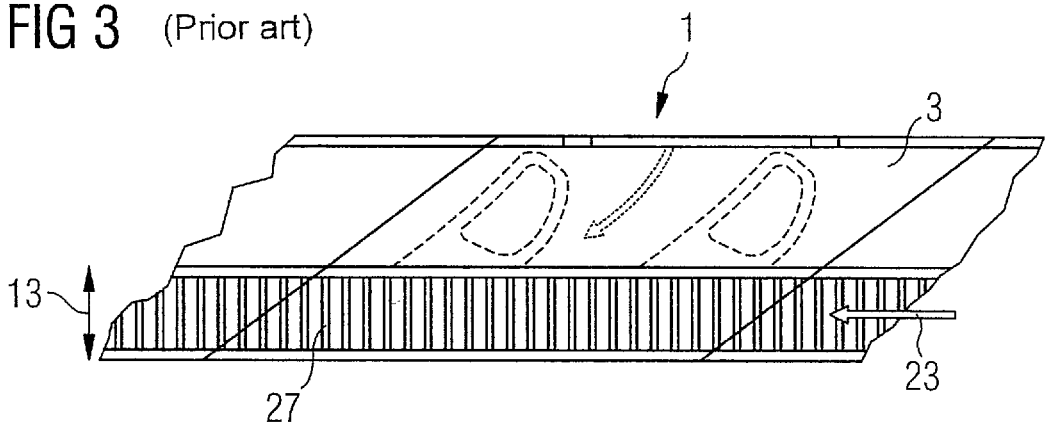
FIG 3 (Prior art)
FIG. 3, already referred to, is a view taken on the line III-III in FIG. 2.

In the part of the gas turbine engine shown in FIG. 4 there is a further flow of cooling fluid that cools trailing edge 43. This flow is indicated by arrows 63, and corresponds to the flow of air present in the prior art as indicated by arrows 19 in FIG. 1.

Cavity 47 also supplies cooling fluid directly to the interior of stator vane 31, as indicated by arrow 65 in FIG. 4. This cooling fluid leaves the main part of stator vane 31 via the trailing edge of this main part, see arrow 67, to join the hot combustion gases of the gas turbine engine.

Figure 6:
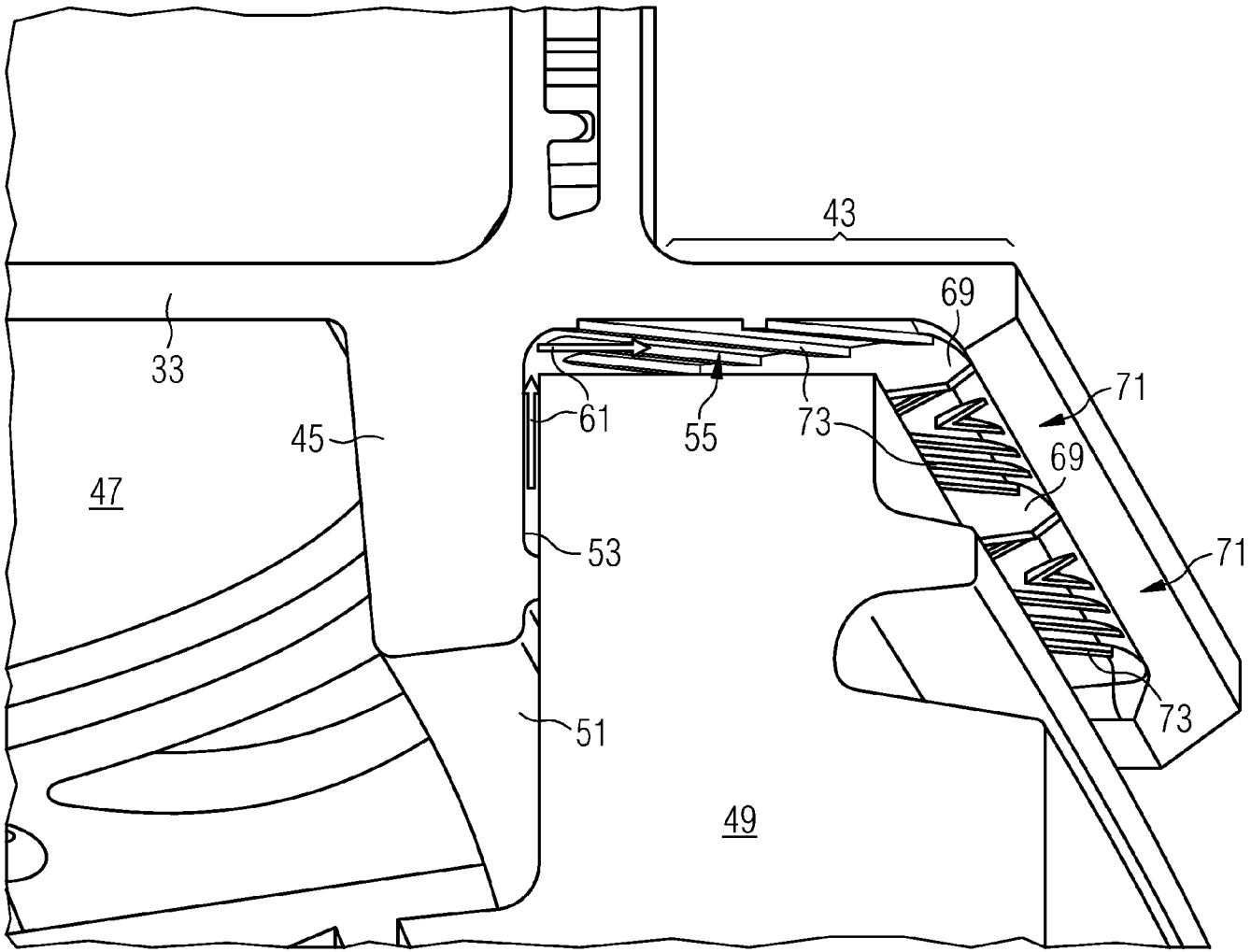
FIG. 6 illustrates certain cooling features incorporated on a trailing edge of a platform shown in FIG. 4.

Referring to FIG. 6, radially inwardly facing side 55 of trailing edge 43 incorporates a number of axially extending wall partitions 69 that divide the side into a number of discrete, axially extending cooling channels 71. Each cooling channel 71 contains a series of chevron turbulators 73 axially spaced along the length of the channel.

Chevron turbulators 73 greatly enhance the cooling of trailing edge 43. Location of the chevron turbulators in discrete cooling channels concentrates the flow on the turbulators enhancing their action.

There may be hot-spots at certain circumferential positions around the trailing edge formed by the trailing edge 43 shown in FIGS. 4 to 6 and the corresponding trailing edges of the other same stage stator vanes of the gas turbine engine. Increased cooling can be applied to these hot-spots by supplying more cooling fluid to the cooling channels 71 that supply these hot-spots. This supply of more cooling fluid could be realised by the formation of radially extending grooves in the interface between carrier ring 49 and downstream facing side 53 of flange 45. The grooves would be formed so as to supply those cooling channels 71 that supply the hot-spots. Alternatively to the grooves, holes could be formed through flange 45 from cavity 47 to cooling channels 71. These holes would be provided in respect of those cooling channels 71 that supply the hot-spots. Thus, the division of radially inwardly facing side 55 into discrete cooling channels 71 enables tailoring of the cooling of the trailing edge formed by trailing edge 43 and the corresponding trailing edges of the other same stage stator vanes of the gas turbine engine.

The above description with reference to FIGS. 4 to 6 concerns a platform of a stator vane disposed at the radially inward side of the vane. It is to be appreciated that the present invention could also be used in respect of a platform of a stator vane disposed at the radially outward side of the vane. For example, a support and cooling arrangement, similar to support and cooling arrangement 41, located generally radially outward of the radially outward platform would (i) direct cooling fluid to an upstream end of a radially outwardly facing side of a trailing edge of the platform, and (ii) direct the cooling fluid to flow over this side in a generally axial direction to a downstream end of the side, and wall partitions, as wall partitions 69, and chevron turbulators, as chevron turbulators 73, would be included on the side.

The invention claimed is:

1. A gas turbine engine, comprising:

a stator vane for directing hot combustion gases onto a plurality of rotor blades; and a support and cooling arrangement, wherein the stator vane includes a platform disposed at a radial inner first side of the vane with respect to an axis of rotation of the engine, wherein the platform includes a trailing edge portion downstream with respect to a flow of the hot combustion gases past the stator vane, wherein the support and cooling arrangement directs a cooling fluid to an upstream end of a second side of the trailing edge portion of the platform, which second side facing radially inward with respect to the axis of rotation of the engine, wherein the support and cooling arrangement also directs the cooling fluid to flow over the second side in a generally axial direction to a downstream end of the second side, the cooling fluid cooling the trailing edge portion as it flows over the second side, and wherein a plurality of turbulators are included on the second side to increase heat transfer from the trailing edge portion as the cooling fluid flows over the second side, the plurality of turbulators extending so as to traverse the axial direction of the axis of rotation of the engine, and wherein the radially inwardly facing second side incorporates a plurality of axially extending wall partitions that divide the second side into a number of discrete axially extending cooling channels the plurality of turbulators included on the second side being located in the cooling channels.

2. The engine according to claim 1, wherein the support and cooling arrangement includes a carrier ring, and a portion of the periphery of the carrier ring lies adjacent the radially inwardly facing second side, the cooling fluid flowing over the second side in the generally axial direction by travelling through a first interface between the second side and the carrier ring.

3. The engine according to claim 2 wherein the platform includes a radially inwardly extending flange at the upstream end of the trailing edge portion, and the portion of the periphery of the carrier ring also lies adjacent to a downstream facing third side of the radially inwardly extending flange, the cooling fluid travelling to the upstream end of the radially inwardly facing second side by travelling generally radially outwardly through a second interface between the downstream facing third side of the flange and the carrier ring.

4. The engine according to claim 3, wherein a cavity for supplying cooling fluid is defined between the platform and the support and cooling arrangement, and the portion of the periphery of the carrier ring also lies adjacent to a radially inwardly facing end of the flange, cooling fluid being supplied by the cavity to the second interface by leaving the cavity in a generally downstream direction through a third interface between the radially inwardly facing end of the flange and the carrier ring.

5. The engine according to claim 4, wherein the cavity also supplies cooling fluid to an interior of the stator vane.

6. The engine according to claim 1, wherein there is a further flow of cooling fluid that cools the trailing edge portion, and this further flow travels past a rotor disk of the engine to which the plurality of rotor blades are attached.

7. The engine according to claim 1, wherein the plurality of turbulators are chevron turbulators.

8. The engine according to claim 1, wherein more cooling fluid is supplied to certain cooling channels than others.

9. The engine according to claim 1, wherein the platform is disposed at the side of the vane radially inward with respect to the axis of rotation of the engine, and the support and cooling arrangement directs the cooling fluid to the upstream end of a radially inwardly facing side of the trailing edge portion of the platform.

* * * * *